United States Patent [19]

Asik et al.

[11] 3,934,570

[45] Jan. 27, 1976

[54] FERRORESONANT CAPACITOR DISCHARGE IGNITION SYSTEM

[75] Inventors: Joseph R. Asik, Bloomfield Hills; Mitsugu Hanabusa, Ann Arbor, both of Mich.

[73] Assignee: Ford Motor Company, Dearborn, Mich.

[22] Filed: Apr. 24, 1974

[21] Appl. No.: 463,919

[52] U.S. Cl. ..... 123/148 E; 123/148 OC

[51] Int. Cl.[2] ..... F02P 3/02

[58] Field of Search ..... 123/148 E, 148 OC; 315/209 CD

[56] References Cited

UNITED STATES PATENTS

| | | | |
|---|---|---|---|
| 3,549,944 | 12/1970 | Minks | 123/148 E |
| 3,593,696 | 7/1971 | Guido | 123/148 E |
| 3,636,936 | 1/1972 | Schuette et al. | 123/148 OC |

*Primary Examiner*—Charles J. Myhre
*Assistant Examiner*—Joseph Cangelosi
*Attorney, Agent, or Firm*—Robert W. Brown; Keith L. Zerschling

[57] ABSTRACT

Capacitor discharge ignition system for a spark-ignition internal combustion engine. The ignition system employs an ignition coil having primary and secondary windings wound on a ferromagnetic core, preferably made of a ferrite material. A first capacitor is connected in series with a spark gap and this series combination is connected across the ignition coil secondary winding. The ignition coil primary winding has a second capacitor coupled to it which capacitor is charged and then discharged in timed relation to engine operation. The first capacitor and ignition coil windings and construction are selected such that the second capacitor when discharged through the ignition coil primary winding produces ferroresonant oscillations in the secondary circuit of the ignition coil. This breaks down the spark gap and an alternating voltage, at the ferroresonant frequency, occurs. The ignition system has fast rise time of the voltage across the spark gap, long duration of the spark and preferably includes restrike capability.

8 Claims, 3 Drawing Figures

FIG. 1.

2a

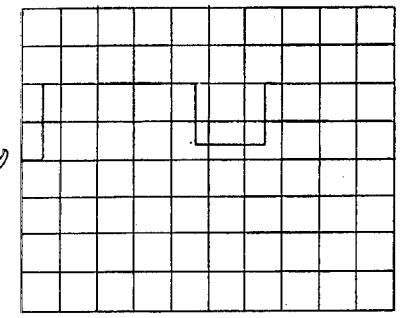

Gate Signal At Pin 2 Of U1
Vert.-5V/Div. Horiz.-50μs/Div.

2b

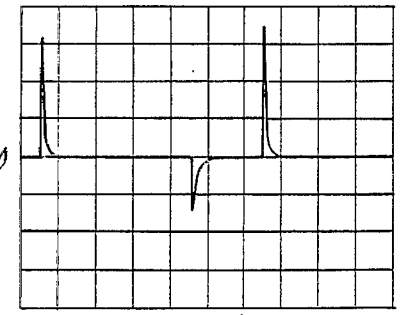

SCR Gate Signal On 470Ω
Resistor R30 To Gate Of Q7
Vert.-10V/Div. Horiz.-50μs/Div.

2c

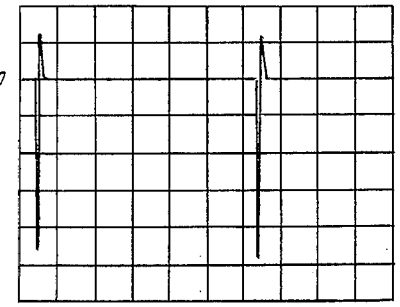

Current Through Primary
Winding P
Vert-50A/Div Horiz.-50μs/Div.

2d

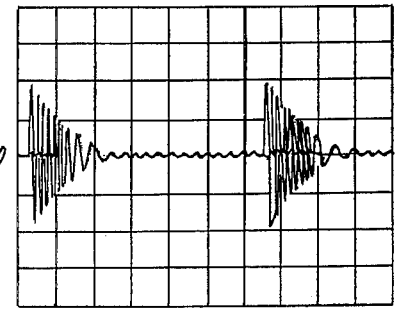

Voltage Across Primary
Winding P
Vert. 50V/Div. Horiz.-50μs/Div.

FIG. 2.

3a

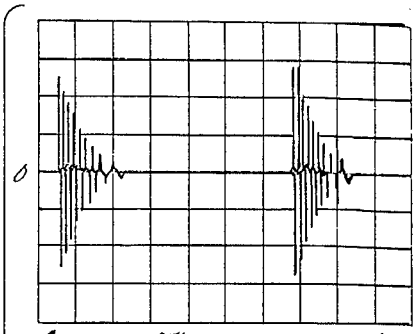

Current Through A 35 Mil
Spark Gap In Air Connected
Across Secondary S
Vert.-2.0A/Div. Horiz.-50μs/Div.

3b

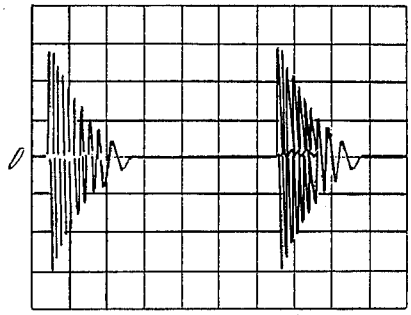

Voltage Across The Capacitor C1
When A 35 Mil Spark Gap In
Air Is Connected Across S
Vert.-5000V/Div. Horiz.-20μs/Div.

3c

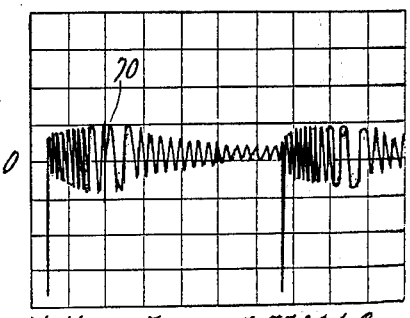

Voltage Across A 35 Mil Spark
Gap In Air Connected Across
Secondary S
Vert.-500V/Div. Horiz-50μs/Div 5d

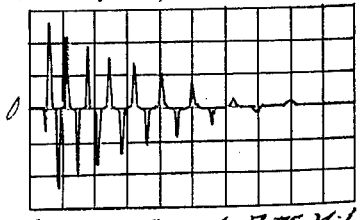

Current Through A 35 Mil
Spark Gap In Air Connected
Across Secondary-S
Vert.-2.0A/Div. Horiz.-10μs/Div.

FIG. 3.

FERRORESONANT CAPACITOR DISCHARGE IGNITION SYSTEM

BACKGROUND

This invention relates to a capacitor discharge ignition system which operates in a ferroresonant mode. The ignition system may be used for a spark-ignition internal combustion engine of the reciprocating or rotary type.

The term "ferroresonant ignition system", as used herein, refers to an ignition system that utilizes an ignition coil having primary and secondary windings wound on a ferromagnetic core. The secondary winding of the ignition coil is coupled to a capacitor connected in series with a spark gap. The voltage across this capacitor and the current flow through the spark gap oscillate at a frequency $f$ defined by the expression:

$$f = V_m/4N_s\phi_s$$

Where $V_m$ is the maximum voltage across the capacitor, $N_s$ is the number of turns in the secondary winding, and $\phi_s$ is the magnetic flux within the secondary winding at magnetic saturation of the ferromagnetic core of the ignition coil.

SUMMARY OF THE INVENTION

The ignition system of the invention is used to provide the spark ignition for an internal combustion engine. As a capacitor discharge ignition system, it has the fast voltage rise time in the ignition coil secondary circuit that is characteristic of such ignition systems. Moreover, long spark duration with restrike capability is provided and a spark voltage and current of alternating character is provided.

The capacitor discharge ignition system of the invention comprises an ignition coil having primary and secondary windings which are wound about a ferromagnetic core. The primary winding preferably has less than five turns and the secondary winding has from 100 to 2000 turns. A spark plug, having electrodes spaced to form a spark gap, has one of its electrodes coupled to one terminal of the ignition coil secondary winding and has its other electrode connected to one terminal of a first capacitor. The other terminal of the first capacitor is connected to the other terminal of the ignition coil secondary winding. Thus, the first capacitor is connected in series with the spark gap, the spark gap and series-connected capacitor being connected across the terminals of the ignition coil secondary winding.

A second capacitor is coupled to the primary winding of the ignition coil. Further, the ignition system includes a DC source of electrical energy and circuit means for charging the second capacitor from the DC source of electrical energy and for discharging the second capacitor through the primary winding of the ignition coil in timed relation to operation of the engine. The first capacitor, the second capacitor and the voltage to which it is charged, and the ignition coil design are selected such that when the second capacitor is discharged through the ignition coil primary winding, an alternating voltage and current are produced in the ignition coil secondary circuit having a ferroresonant frequency $f$ defined by the expression previously given. This ferroresonance in the secondary circuit is characterized by the ignition coil ferromagnetic core repeatedly becoming saturated and unsaturated at a frequency corresponding to the ferroresonant frequency $f$.

The invention may be better understood by reference to the detailed description which follows and to the drawings.

BRIEF DESCRIPTION OF THE DRAWINGS

FIG. 2 contains four waveforms illustrating various signals which occur in the circuitry on the primary side of an ignition coil illustrated in the schematic diagram of FIG. 1; and FIG. 3 contains four waveforms which occur in the circuitry on the secondary side of the ignition coil in the schematic diagram of FIG. 1.

DETAILED DESCRIPTION

Figure 1:
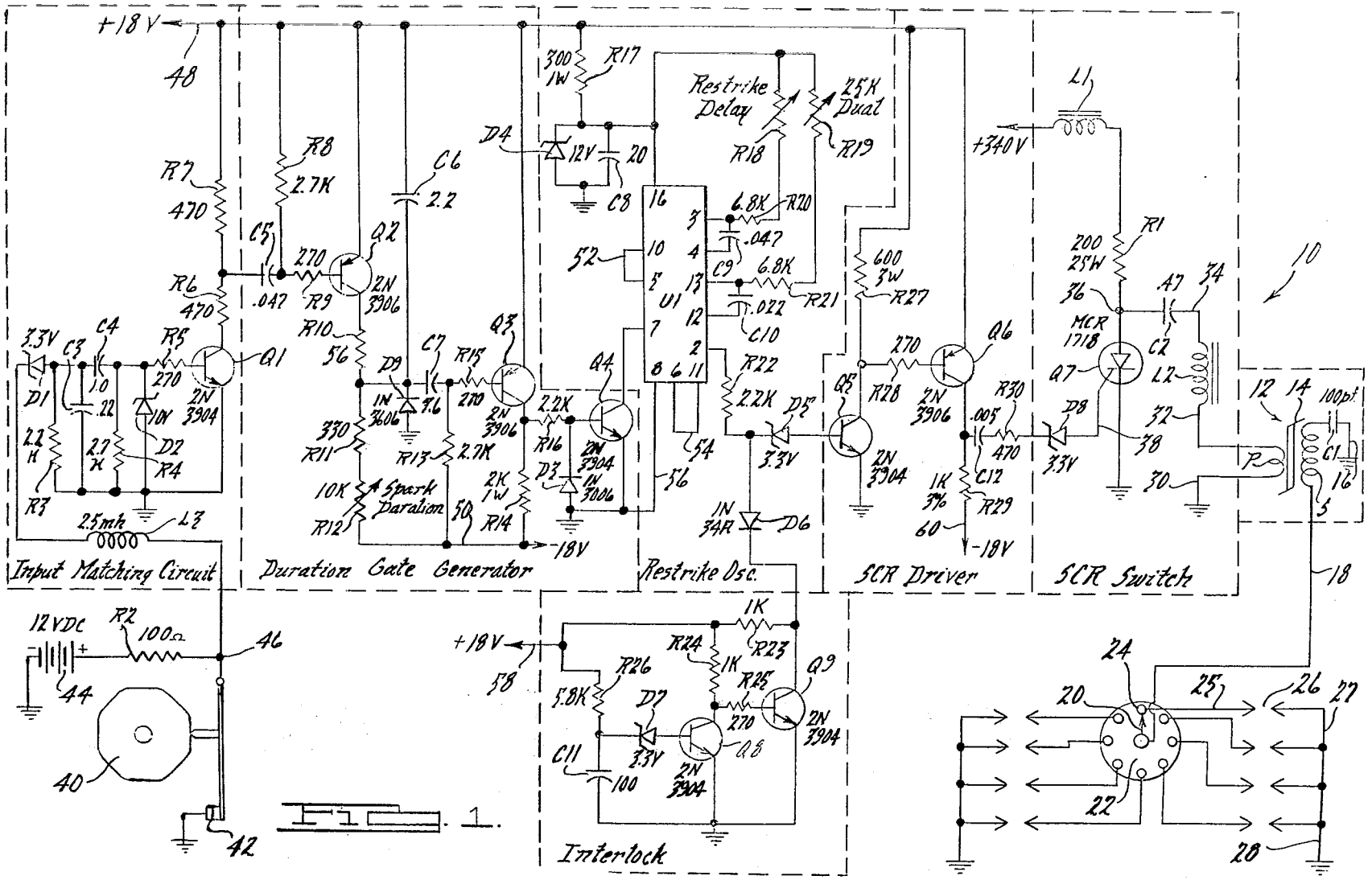
FIG. 1 is a schematic diagram of a capacitor discharge ignition system in accordance with the invention.

With reference now to the drawings, there is shown in FIG. 1 a schematic diagram of an ignition system in accordance with the invention. The ignition system, generally designated by the numeral 10, produces ferroresonant oscillations in the secondary circuit of an ignition coil 12 having a primary winding P and a secondary winding S. The ignition coil 12 has a ferromagnetic core 14 which in the circuit 10 is capable of being saturated repetitively after the initial breakdown of a spark gap 26. More specifically, the secondary winding S of the ignition coil has one of its leads connected to one terminal of a capacitor C1. The other terminal of the capacitor C1 is connected to ground at 16. A lead 18 extends from the other terminal of the secondary winding S to the rotor 20 of a conventional distributor 22 for a spark ignition internal combustion engine. The distributor 22 has eight contacts 24 which are repetitively and serially contacted by the rotor 20 such that repetitive electrical contact is made with the eight spark gaps 26 contained in the spark plugs of the internal combustion engine. Thus, each of the spark plugs has one of its electrodes, represented by a lead 25, connected to the secondary winding S of the ignition coil and has its other electrode 27 connected to ground at 28. It should be noted that the ground connections 16 and 28 are common and, therefore, each of the spark gaps 26 is connected, sequentially as the rotor 20 rotates, in series with the capacitor C1. The capacitor C1 need not be located as shown in FIG. 1, but rather may be connected in series with the spark gap 26, for example, by its insertion in the lead 18, the lead 25 or the lead 27. If the capacitor C1 is inserted in the leads 25 or 27, a separate capacitor is required for each spark gap. Similarly, a separate secondary winding S may be provided for each of the spark gaps 26 if desired. Separate secondary windings S and capacitors C1 for each of the spark gaps 26 may be housed within the spark plug, for example, as depicted in the spark plug design of U.S. Pat. No. 3,267,325 issued Aug. 16, 1966 to J. F. Why.

The primary winding P of the ignition coil 12 has one of its terminals connected to ground at 30 and has its other terminal 32 coupled, through a saturable, ferromagnetic-core inductor L2 and a lead 34, to a capacitor C2. The capacitor C2 is connected to a junction 36 formed between a resistor R1 and the anode of a semiconductor controlled rectifier (SCR)Q7. The cathode of the SCR is connected to ground. The SCR has a gate or control electrode 38. The current limiting resistor R1 is connected through another saturable, ferromagentic-core inductor L1 to a +340 volt DC source of electrical energy. This voltage, as well as the other DC voltages shown in FIG. 1, may be obtained from a 12 volt DC source of electrical energy, such as the storage battery 44 conventional in motor vehicles, through use of a DC to DC converter well known to those skilled in the art.

The remainder of the circuitry shown in FIG. 1, together with the SCR Q7 and its connections, comprise circuit means for charging the capacitor C2 from the DC source of electrical energy and for discharging this capacitor through the primary winding P in timed relation to operation of the engine. The charging and discharging of the capacitor C2 in timed relation to engine operation may be obtained in the conventional manner by a cam 40 mechanically coupled to the distributor rotor 20, driven by the engine, and used to intermittently open and close a set of breaker points 42, one of which is connected to ground and the other of which is connected to a junction 46. Because the DC source of electrical energy 44 has its negative terminal connected to ground and has its positive terminal connected through a resistor R2 to the junction 46 the junction 46 is at ground potential when the breaker points 42 are closed and is at the +12 volt potential of the storage battery 44 when the breaker points are open. The voltage rise at the junction 46 which occurs each time the breaker points open is supplied to an input matching circuit to cause the production of a spark in one of the spark gaps 26.

As is indicated by broken lines enclosing various designated circuit portions, the circuitry 10 includes an input matching circuit, the function of which is to couple the pulses occurring at the junction 46 to a duration gate generator. The duration gate generator produces a pulse output signal which has a controllable duration and which is supplied to a restrike oscillator. The function of the restrike oscillator is to produce one or more pulse signals during the duration of the signal from the duration gate generator. Each pulse produced at the output of the restrike oscillator is used to initiate the discharge of the capacitor C2 through the ignition coil primary winding P. The output pulses from the restrike oscillator circuit are supplied to an SCR driver circuit which utilizes the restrike oscillator pulses to produce pulse spikes which are applied to the gate 38 of the SCR Q7. An interlock circuit is provided to prevent, when the ignition circuit 10 is first put into operation, the supply of a pulse to the gate electrode 38 until the capacitor C2 has had sufficient time to charge. In the paragraphs which follow, the above circuit portions are described in detail.

The input matching circuit includes a choke inductor L3 which has one of its terminals connected to the junction 46 and which has its other terminal connected to the cathode of a zener diode D1. The anode of this zener diode is coupled to ground through a resistor R3 connected in parallel with a noise suppression capacitor C3. The anode of the zener diode also is connected through the series combination of a DC blocking capacitor C4 and a current limiting resistor R5 to the base of an NPN transistor Q1. The junction formed between the capacitor C4 and the resistor R5 is connected to the cathode of a zener diode D2 whose anode is connected to ground. A resistor R4 is connected in parallel with the zener diode D2. The emitter of the transistor Q1 also is connected to ground and its collector is connected through resistors R6 and R7 to a +18 volt DC supply lead 48.

The function of the resistor R3 and capacitor C3 is to suppress high frequency noise signals that may appear at the anode of the zener diode D1. The capacitor C4 permits the positive step voltage, which occurs at the junction 46 when the breaker points 42 open, to momentarily pass through the resistor R5 to the base of the transistor Q1 to render it momentarily conductive in its collector-emitter output circuit. This permits current to flow through the resistors R7 and R6 to ground.

The duration gate generator has a blocking capacitor C5 connected to the junction formed between the resistors R6 and R7. The opposite terminal of the capacitor C5 is connected through a current limiting resistor R9 to the base of a PNP transistor Q2. The junction formed between the capacitor C5 and the resistor R9 is connected through a resistor R8 to the voltage supply lead 48. The emitter of the transistor Q2 also is connected to the supply lead 48 and its collector is connected through series-connected resistors R10, R11 and R12 to a −18 volt DC supply lead 50. The resistor R12 is variable and controls the duration (total length of time) of multiple spark discharges produced in a given spark gap 26 during one combustion cycle in the engine. More specifically, the resistor R12 controls the duration of the output signal pulse from the duration gate generator. In a reciprocating sparkignition internal combustion engine, the length or duration of this output pulse is the length of time available for the production of one or more sparks in the spark gap 26 in a given cylinder to cause ignition of a combustible mixture of fuel and air and a resultant power stroke of the piston in that cylinder.

The capacitor C6 has one of its terminals connected to the voltage supply lead 48 and has its other terminal connected to the junction formed between the resistors R10 and R11. Also connected to this junction is the cathode of a clamping diode D9 which has its anode connected to ground. The diode D9 limits the negative voltage at this junction to one diode voltage drop below ground potential. The junction formed between the resistors R10 and R11 also is connected through a coupling capacitor C7 and a current limiting resistor R15 to the base of a PNP transistor Q3. The junction formed between the capacitor C7 and resistor R15 is connected through a resistor R13 to the negative voltage supply lead 50. The collector of the transistor Q3 also is connected through a resistor R14 to the supply lead 50, and the emitter of this transistor is connected to the positive voltage supply lead 48. The collector of the transistor Q3 is connected through a resistor R16 to the base of a NPN transistor Q4 whose emitter is connected to ground. A clamping diode D3 has its cathode connected to the base of the transistor Q4 and has its anode connected to ground to limit the base voltage to one diode voltage drop below ground potential. The output signal of the duration gate generator is taken at the collector of the transistor Q4 which is connected to pin 7 of a dual monostable multivibrator U1, which as shown is a Teledyne type 342. A Texas Instruments type 15,342 or the equivalent also may be used for U1.

The duration gate generator is a sawtooth generator which is triggered when the transistor Q1 is rendered conductive, which occurs, as previously stated, when the breaker points 42 open. When the transistor Q1 is rendered conductive, the resistor R8 and capacitor C5 differentiate the resulting negative voltage step at the collector of Q1. The negative voltage spike which results is applied to the base of the transistor Q2. This renders the transistor Q2 conductive in its emitter-collector output circuit for a time sufficient to permit the discharge of the capacitor C6 through the resistor R10 and the emitter-collector circuit of the transistor Q2. The capacitor C6 will have previously been charged to a voltage slightly in excess of 18 volts DC. The transistor Q3 is normally conductive in its emitter-collector output circuit due to the flow of current from the voltage supply lead 48, through its emitter-base junction, through the resistor R15, and primarily through the resistor R13 to the negative voltage supply lead 50. However, when the capacitor C6 discharges, a positive voltage approximately equal to the voltage on the supply lead 48 appears at the junction formed between resistors R10 and R11. This voltage is applied through the capacitor C7 and the resistor R15 to the base of the transistor Q3 to render it nonconductive. The transistor Q3 remains nonconductive for the length of time required for the capacitor C6, after the transistor Q2 again becomes nonconductive, to recharge through the series resistors R11 and R12. Typically, the transistor Q3 is nonconductive and for so long as it is nonconductive, the transistor Q4 has no base drive and also is nonconductive which results in the application of a positive voltage at the pin 7 of the dual monostable multivibrator U1.

The dual monostable multivibrator U1 has one monostable multivibrator with an input $A_1$ and an output $\overline{Q}_1$. The other monostable multivibrator in the integrated circuit U1 has an input $A_2$ and an output $\overline{Q}_2$. By the connection of the $\overline{Q}_1$ output to the $A_2$ input and the connection of the $\overline{Q}_2$ output to the $A_1$ input, as is accomplished by the connection of the lead 52 between the pins 5 and 10 and the connection of the lead 54 between the pins 7 and 11, the dual monostable multivibrator U1 becomes a pulse generator, the output of which is taken at its pin 2. The Q1 output at pin 2 alternates between a high voltage level of about 10 volts and a low voltage level near ground potential. With the circuit values indicated in the drawing, the high voltage portion of the signal at pin 2 is approximately 68% of the signal period. Dual variable resistors R18 and R19 are connected, respectively, through a resistor R20 and a capacitor C9 to the pins 3 and 4 and through a resistor R21 and a capacitor C10 to the pins 12 and 13. These components determine the duty cycle or pulse width at output pin 2 of the multivibrator and permit the period of the signal at pin 2 to be varied from about 0.30 ms to 1.5 ms. The period of the signal at pin 2 represents the restrike delay, that is, the delay between multiple ignition sparks produced in each of the spark gaps 26 by repetitive triggering of the SCR Q7.

The dual monostable multivibrator U1 is gated or triggered when the output circuit of the transistor Q4 is rendered nonconductive. When the transistor Q4 is conductive, the signal at pin 2 of the dual monostable multivibrator U1 remains constant at a low voltage level, but when the transistor Q4 becomes nonconductive, gating multivibrator U1, the signal at pin 2 becomes a series of pulses which continually gate the SCR Q7 to produce a spark in a spark gap 26 each time a pulse occurs at pin 2. These repetitive and restriking sparks continue to occur until the transistor Q4 is once again rendered conductive.

The dual monostable multivibrator U1 receives its positive voltage supply from a voltage regulator comprising a resistor R17 connected in series with the parallel combination of a zener diode D4 and a capacitor C8. The junction formed between these components is connected to the voltage supply pin 16 of U1 and also is connected to the variable resistors R18 and R19. Pin 8 of the multivibrator U1 is connected to ground. Pin 2 of the multivibrator is connected through a current limiting resistor R22 and a zener diode D5 to the base of an NPN transistor Q5.

The transistor Q5 is located in the SCR driver portion of the circuit 10 and has its emitter connected to ground. Its collector is connected through a resistor R27 to the voltage supply lead 48 and also is connected through a current limiting resistor R28 to the base of a PNP transistor Q6. The emitter of the transistor Q7 is connected to the voltage supply lead 48 and its collector is connected through a resistor R29 and a lead 60 to a −18 volt DC voltage supply. The collector of the transistor Q6 also is connected, through a series circuit including differentiating capacitor C12, resistor R30 and zener diode D8, to the gate electrode 38 of the SCR Q7.

The waveforms shown in FIGS. 2 and 3 are representations of signals which occur at various points in the circuit schematically illustrated in FIG. 1, with the exception that the waveforms *3a*, *3c* and *3d* pertain to a 35 mil spark gap located in air at atmospheric pressure rather than to a spark gap located in the cylinder of an operating internal combustion engine.

FIG. *2a* shows the voltage waveform that occurs at pin 2 of the dual monostable multivibrator U1. This voltage is the oscillatory output voltage of the multivibrator which occurs so long as the input transistor Q4 connected to its pin 7 is in a nonconductive state. Of course, Q4 is rendered nonconductive each time, and for a predetermined time established by the duration gate generator, that the cam 40 opens the breaker points 42. On each positive going edge of the pulses in FIG. *2a*, the transistor Q5 is rendered conductive. This reduces its collector voltage to substantially ground potential to cause the conduction of the PNP transistor Q6. When nonconductive, the collector of the transistor Q6 is at approximately −18 volts DC, but when rendered conductive, its collector achieves a voltage of almost +18 volts DC. This step voltage on the collector of the transistor Q6 is differentiated by the capacitor C12 to produce a voltage spike which gates the SCR Q7. The voltage spikes are represented in FIG. *2b*, which illustrates the voltage occuring on the resistor R30 at points corresponding to the positive going edges of the pulses of FIG. *2a*, which pulses occur at pin 2 of the multivibrator. Thus, it is apparent that the SCR Q7 is gated or triggered on each positive going edge of the oscillatory signal occurring at pin 2 of the multivibrator U1 and that this continues so long as the transistor Q4 is nonconductive. If the duration gate generator is adjusted such that the transistor Q4 is nonconductive for 5 milliseconds and if the restrike delay resistors R18 and R19 are adjusted such that the signal of FIG. *2a* has a period of 0.33 ms, then the gate 38 of the SCR Q7 will receive 16 trigger pulses during the course of the 5 ms that the transistor Q4 is nonconductive. This produces a corresponding 16 spark discharges in a single one of the spark gaps 26. It should be noted that 5 ms is precisely the time required for the piston in an eight-cylinder, four-cycle reciprocating internal combustion engine to travel from its top-dead-center position to its bottom-dead-center position when the engine is operating at 6,000 rpm.

With respect to the interlock portion of the circuitry 10, it may be seen that this circuit portion comprises NPN transistors Q8 and Q9. The emitters of these transistors are connected to ground potential. The collector of the transistor Q9 is connected, through a diode D6, to the junction formed between the resistor R22 and the zener diode D5. The collector of this transistor also is connected through a resistor 23 to a lead 58 connected to a +18 volt DC source of electrical energy. A current limiting resistor R25 is connected between the lead 58 and the collector of the transistor Q8. The collector of the transistor Q8 also is connected through a current limiting resistor R25 to the base of the transistor Q9. A series-connected resistor R26 and capacitor C11 are connected between the lead 58 and ground potential. The junction formed between the resistor R26 and the capacitor C11 is connected through a zener diode D7 to the base of the transistor Q8. Upon the initial application of the DC supply potential to the lead 58, the transistor Q9 immediately is conductive in its collector-emitter output circuit. This has the effect of connecting the pin 2 output of the multivibrator U1 to ground potential to prevent the conduction of the transistor Q5 and, consequently, to prevent the supply of a triggering pulse to the gate electrode 38 of the SCR Q7. At this time, the transistor Q8 is nonconductive in its output circuit because the capacitor C11 forms an effective short circuit of its base-emitter circuit. However, the continued application of the DC voltage on the lead 58 causes the capacitor C11 to be charged through the resistor R26.

When the voltage on the upper terminal of the capacitor C11 exceeds the sum of the breakdown voltage of the zener diode D7 and the base-emitter voltage drop required to render the transistor Q8 conductive, then the collector-emitter circuit of transistor Q8 becomes conductive and shunts the base-emitter circuit of the transistor Q9. The transistor Q9 then becomes nonconductive and the positive going edges of the oscillatory signal at pin 2 of the multivibrator U1 are permitted to cause the repetitive triggering of the gate electrode 38 of the SCR Q7. The time required to charge the capacitor C11 exceeds considerably the time required to charge the capacitor C2 connected to the primary winding P of the ignition coil 12. The capacitor C2 must be fully charged before the SCR Q7 is triggered because the latter is self-commutated as a result of the discharge of the capacitor C2 through it and the primary winding P. Of course, the interlock circuitry shown in FIG. 1 may be replaced by gate circuitry which prevents the application of a trigger signal on the gate electrode 38 of the SCR prior to the required charge level on the capacitor C2 being attained.

When the SCR Q7 is nonconductive between its anode and cathode, the capacitor C2 is charged from the +340 volt DC power supply through the current path including the inductor L1, the resistor R1, the inductor L2, the primary winding P of the ignition coil 12 and the ground circuit. When the SCR Q7 is triggered by a positive pulse applied to its gate electrode 38, a current pulse is produced. Two such current pulses, caused by two successive trigger pulses applied to the gate electrode 38, are shown in the waveform of FIG. 2*c*. It may be seen that these current pulse have an alternating current waveform. At the end of the pulse, the SCR Q7 is self-commutated. This self-commutation is aided by the saturable inductor L2 which offers little impedance to current flow due to its saturable character.

FIG. 2*d* shows the voltage across the primary winding P upon the occurrence of the current pulses shown in FIG. 2*c*. It may be seen that this voltage is oscillatory and has a magnitude which decreases in a substantially exponential manner. It should be noted that the frequency at the maximum amplitude, left-hand portions of the oscillations are at a higher frequency than the frequency which occurs thereafter. In other words, the oscillation frequency decreases with voltage amplitude and as a function of time for reasons hereinafter explained.

With reference now to the waveforms of FIG. 3, which waveforms have phase correspondence to the signals of FIG. 2, there is shown in FIG. 3*a* the current flow through a 35 mil spark gap in air, at atmospheric pressure, the spark gap being connected in series with the capacitor C1 and across the secondary winding S of the ignition coil 12 as shown in FIG. 1. From this waveform, it may be seen that the current through the spark gap reverses in direction, that is, it is a truly alternating current waveform, and oscillates at a variable frequency. Further, the magnitude of the current decays in a substantially exponential manner during the course of its oscillation. FIG. 3*d* is an expanded view, on a 20 microsecond per division time scale, of one of the oscillatory cycles shown in FIG. 3*a*. From FIG. 3*d*, it may be seen that the oscillations are not sinusoidal but rather are characterized by alternating current peaks which suddenly occur during the buildup of current in the spark gap. This is an important characteristic of the ferroresonant capacitor discharge ignition system of the invention. The frequency of the resonance is variable and defined by the equation $f = V_m/4N_s\phi_s$ where $f$ is the frequency, $V_m$ is the instantaneous maximum voltage across the capacitor C1, $N_s$ is the number of turns in the secondary winding S of the ignition coil 12 and $\phi_s$ is the magnetic flux within the secondary winding S of the ignition coil 12. The shape of the alternating current waveform of FIGS. 3*a* and 3*d* is the result of the ferromagnetic core 14 of the ignition coil alternating between saturated and unsaturated conditions as a result of the discharge of the capacitor C2 through the primary winding P of the ignition coil. This produces the ferroresonant condition in the secondary circuit, which is described and defined by the foregoing equation. Of course, the direction of the magnetic flux in the ferromagnetic core alternates such that the core saturates in one direction, becomes unsaturated, and then saturates in the opposite direction.

In FIG. 3*a*, each of the oscillatory currents represents a separate spark discharge. Thus, multiple spark discharges or restrikes may occur. In fact, the circuitry shown in FIG. 1 is capable of producing 15 spark restrikes in a given spark gap 26 in a single combustion cycle in one cylinder of a reciprocating internal combustion engine.

In FIG. 3*b*, there is shown the voltage across the capacitor C1 when a 35 mil spark gap in air is connected to the secondary winding S of the ignition coil in the manner shown in FIG. 1. Each of the two oscillatory voltage periods shown is characterized by a substantially exponentially decreasing voltage which begins at a high frequency and gradually decreases in frequency in accordance with the ferroresonant frequency defined by the foregoing equation.

FIG. 3c shows the voltage across the 35 mil spark gap in air connected to the secondary winding S as shown in FIG. 1. From this waveform, it may be seen that the spark gap voltage is alternating above and below ground potential and that during the current discharge through the spark gap the voltage waveform has a substantially square wave shape, with notch-like portions 70, which continues as long as current flows through the spark gap. At the cessation of current flow, a substantially sinusoidal and decreasing magnitude voltage occurs across the spark gap. The notch-like portions 70 are due to the large current flow, which produces a strong arc, through the spark gap.

The voltage and current waveforms shown in FIGS. 2 and 3 were obtained with an ignition coil 12 having a primary winding of one turn and a secondary winding of 160 turns. The primary winding P and secondary winding S were wound on a ferrite (manganese zinc) core having the shape of a closed, hollow cylinder with a central core running along its axis. The cylinder has an outside diameter of 42 millimeters and a height of 29 millimeters. The primary and secondary windings were wound about the central core. The capacitor C1 has a value of 50 picofarads. The remaining components in the circuit of Figure were of the values indicated therein. The capacitance values are given in microfarads, unless otherwise specified, and the resistance values are in ohms or, as indicated, in kilohms.

The design of the saturable ferromagnetic ignition coil 12 is not critical and may take various forms other than that described in the preceding paragraph. Also, the value of the capacitor C1 is of importance in producing ferroresonance in the secondary circuit during the discharge of the capacitor, C2 through the ignition coil primary winding P, but the capacitance C1 may be within a broad range. Values in excess of 1,000 picofarads for the capacitor C1 have been used.

The DC voltage supply for charging the capacitor C2 and the value of this capacitor must be sufficiently large to permit the discharge of this capacitor through the primary winding P of the ignition coil 12 to produce a ferroresonant condition, as depicted in FIGS. 2 and 3, in the ignition system.

The circuitry of FIG. 1 is designed to provide multiple sparks during a given combustion cycle in a given combustion chamber of an engine. If it is desired to produce only one spark per combustion cycle, then the circuitry used to trigger the SCR Q7, or an equivalent device, need only comprise means, such as the cam 40 and breaker points 42, for triggering the discharge of the capacitor C2 through the primary winding P. Of course, a transistorized ignition system using a pulse generator driven by a distributor or the like may be used in place of the cam 40 and breaker points 42. Such breakerless ignition systems are well known.

Based on the foregoing description of the invention, what is claimed is:

1. In combination with an internal combustion engine, a capacitor discharge ignition system which comprises:

an ignition coil having primary and secondary windings and a ferromagnetic core about which said windings are wound;

a spark plug having electrodes spaced to form a spark gap, one of said electrodes being coupled to one terminal of said secondary winding;

a first capacitor connected in series with said spark gap, one terminal of said capacitor being coupled to the other terminal of said secondary winding;

a second capacitor coupled to said primary winding;

a DC source of electrical energy;

circuit means for charging said second capacitor from said DC source of electrical energy and for discharging said second capacitor through said primary winding in timed relation to operation of said engine; and said second capacitor when discharged through said primary winding producing ferroresonant oscillations in the secondary circuit of said ignition coil.

2. In combination with an internal combustion engine, a capacitor discharge ignition system which comprises:

an ignition coil having primary and secondary windings and a ferromagnetic core about which said primary and secondary windings are wound;

a spark plug having electrodes spaced to form a spark gap, one of said electrodes being coupled to one terminal of said secondary winding;

a first capacitor connected in series with said spark gap, one terminal of said capacitor being coupled to the other terminal of said secondary winding;

a second capacitor coupled to said primary winding;

a DC source of electrical energy;

circuit means for charging said second capacitor from said DC source of electrical energy and for discharging said second capacitor through said primary winding in timed relation to operation of said engine; and the capacitance of said second capacitor and the magnitude of said DC source of electrical energy being such that when said second capacitor is discharged through said primary winding, the portion of said ferromagnetic core about which said secondary winding is wound alternates between a saturated and unsaturated condition, an alternating current flows through said spark gap and a voltage is produced across said first capacitor which has a frequency $f = V_m/4N_s\phi_s$ where $V_m$ is the instantaneous maximum voltage across said first capacitor, $N_s$ is the number of turns in said secondary winding, and $\phi_s$ is the magnitude of the magnetic flux within said secondary winding at saturation of said ferromagnetic core.

3. An ignition system according to claim 2 wherein said first capacitor has a capacitance value in the range from 50 to 1,000 picofarads.

4. An ignition system according to claim 2 wherein said circuit means includes means for generating a gate signal in timed relation to operation of said engine and circuit means, supplied with said gate signal, for generating an oscillatory signal during said gate signal, said oscillatory signal controlling the frequency at which said second capacitor is discharged through said primary winding.

5. An ignition system according to claim 4 wherein said oscillatory signal has a period in the range from 0.30 ms to 1.5 ms.

6. An ignition system according to claim 5 wherein said gate signal has a duration within the range from 1 ms to 5 ms.

7. An ignition system according to claim 4 wherein said circuit means for charging and discharging said second capacitor further includes interlock circuit means for preventing the discharge of said second capacitor until said second capacitor has been charged from said DC source of electrical energy.

8. An ignition system according to claim 4 wherein said circuit means for charging and discharging said second capacitor includes a dual monostable multivibrator connected as an oscillator for producing said oscillatory signal, said dual monostable multivibrator being triggered by said gate signal.

* * * * *